United States Patent [19]

Shenoy et al.

[11] 3,990,847

[45] Nov. 9, 1976

[54] CREASEPROOFING COMPOSITION

[75] Inventors: Purushotham K. Shenoy, North Augusta; William B. Robertson, Belvedere, both of S.C.

[73] Assignee: United Merchants and Manufacturers, Inc., New York, N.Y.

[22] Filed: June 18, 1975

[21] Appl. No.: 587,931

Related U.S. Application Data

[63] Continuation of Ser. No. 178,395, Sept. 7, 1971, abandoned.

[52] U.S. Cl. ..... 8/187; 252/8.8

[51] Int. Cl.[2] ..... D06M 15/54

[58] Field of Search ..... 8/187; 252/8.8; 260/482 B, 482 C

[56] References Cited

UNITED STATES PATENTS 3,524,876 8/1970 Gregson ..... 8/187

3,639,455 2/1972 Petersen et al. ..... 260/482 C

FOREIGN PATENTS OR APPLICATIONS 1,123,677 8/1968 United Kingdom ..... 8/187

*Primary Examiner*—John Kight, III

*Attorney, Agent, or Firm*—Michael A. Caputo; John P. McGann

[57] ABSTRACT

A creaseproofing composition prepared by reacting urea with a monoalkyl ether of an ethylene glycol having 1 to 10 ethyleneoxy groups, removing the excess monoalkyl ether and then reacting the remaining mixture without isolation of any carbamate formed with formaldehyde. The composition obtained and its method of use as a creaseproofing chemical are described.

12 Claims, No Drawings

CREASEPROOFING COMPOSITION

CROSS REFERENCE TO RELATED APPLICATIONS

This application is a continuation of copending application Ser. No. 178,395, filed on Sept. 7, 1971, now abandoned.

BACKGROUND OF THE INVENTION

1. Field of the Invention

This invention pertains to the field of the treatment of cellulosic fabrics to impart crease resistance thereto. More particularly, the present invention concerns a new creaseproofing composition.

2. Description of the Prior Art

The use of methylolated carbamates as creaseproofing chemicals is known. (See U.S. Pat. Nos. 3,524,876 and 3,369,858).

Such chemicals are, however, relatively expensive due to their method of manufacture. Thus, such chemicals are normally prepared by reacting urea with a monoalkyl ether of an ethylene glycol to prepare the desired carbamate. The resulting carbamate is then purified by filtration, precipitation, crystallization, and re-crystallization.

The purified carbamate is then further reacted with formaldehyde to form the corresponding condensation product which is the dimethylolated carbamate. Thus, as a result of the need to carefully and completely purify the initial carbamate, the cost of the final creaseproofing is relatively high.

SUMMARY OF THE INVENTION

We have discovered a new creaseproofing composition which performs at levels equivalent to those of the prior art methylolated carbamates, but which is substantially less expensive than such prior materials.

The composition of the present invention is prepared by first reacting urea with a monoalkyl ether of an ethylene glycol having 1 to 10 ethyleneoxy groups wherein the alkyl group contains 1 to 6 carbon atoms. The excess monoalkyl ether is then removed and the remaining reaction mixture without further separation of any carbamate formed therein is reacted with aqueous formaldehyde. The resulting reaction mixture is then used directly as a creaseproofing chemical.

Thus, the time consuming and wasteful step of purifying the carbamate is eliminated. Additionally, the hazards of spontaneous, exothermic polymerization of the crude product during the purification is avoided.

DESCRIPTION OF THE PREFERRED EMBODIMENT

The novel creaseproofing composition of the present invention is prepared by first reacting urea with a monoalkyl ether of an ethylene glycol having 1 to 10 ethyleneoxy groups wherein the alkyl group contains 1 to 6 carbon atoms. Illustrative monoalkyl ethers include the monoethyl ether of ethylene glycol or Cellosolve, the monohexyl ether of ethylene glycol, the monomethyl ether of deca-ethylene glycol, the monobutyl ether of triethylene glycol, the monoisobutyl ether of tetraethylene glycol, and the like. The reaction with urea is preferably carried out at elevated temperature, preferably above 100° C. The reaction is accompanied by the evolution of ammonia which can be used as an indication of the extent of reaction that has taken place at any given time. A high boiling solvent or diluent, such as glycerol, can be employed if desired.

Generally, a 100 to 400% stoichiometric excess of the monoalkyl ether is used and the reaction is carried out at a temperature in the range from about 120° to 150° C and for a time sufficient to allow the urea level to decrease to about 1 to 8%, and preferably about 4 to 6% of its original level.

If desired, an alkaline catalyst or a combination of alkaline catalysts, such as N, N, N'N' - tetramethylethylene diamine, N, N, N'N' tetramethyl 1,3 butanediamine, N, N, dimethylaminoethanol and triethanolamine may also be used but is not necessary.

The unreacted monoalkyl ether is then removed from the mixture as by distillation.

The reaction mixture thus obtained is composed of about 87–99% by weight of a carbamate having the formula:

$$RO(CH_2CH_2O)_n\underset{\underset{O}{\|}}{C}NH_2$$

wherein $n$ is an integer from 1 – 10 and, wherein R is an alkyl group having 1 to 6 carbon atoms; about 1–8% by weight urea and about 1–5% by weight cyanuric acid.

Preferably, the mixture contains a carbamate having the above formula wherein $n = 1$ and wherein R is methyl, ethyl, propyl, isopropyl, butyl, isobutyl, pentyl, isopentyl, hexyl and tthe like.

Particularly preferred carbamates are ethoxyethyl carbamate, methoxyethyl carbamate, propoxyethyl carbamate, isopropoxyethyl carbamate, butoxyethyl carbamate, isobutoxyethyl carbamate, pentoxyethyl carbamate, and hexoxyethyl carbamate.

After removal of the monoalkylether, the remaining reaction mixture, without separation or purification of any carbamate therein is reacted with aqueous formaldehyde. The conditions under which this reaction is carried out are not narrowly critical, with optimum conditions being determined primarily by the particular carbamate in the mixture. The reaction may be effected at temperatures of from about 20° C. to the reflux temperature of the reaction mixture, with reaction times of from several minutes to as much as 24 hours, and preferably from about 1 to about 5 hours. The amount of formaldehyde used is in a ratio of from about 1.5 to about 3 moles of formaldehyde per mole of carbamate in the mixture, the optimum amount depending on the particular carbamate. Initial pH of the reaction mixture may be in the range from about 4 to about 11, with the optimum level depending on the carbamate involved. Fro example, with the alkoxyalkyl carbamates the initial pH is preferably from about 8 to about 10.

Preferably, the mixture is reacted with the aqueous formaldehyde at a temperature in the range from about 60° to 100° C at a pH of about 9 – 10.

In accordance with another embodiment of the present invention, if desired, one may prepare a mixture of any of the foregoing carbamates, urea, and cyanuric acid in the amounts of about 87–99% by weight, 1–8% by weight, and 1–5% by weight, respectively, and reacting this mixture with aqueous formaldehyde as outlined above.

The mixture obtained from the foregoing described process comprises the creaseproofing composition of the present invention. Such composition comprises from about 2 to 12% by weight formaldehyde; from about 72 to 95% by weight methylolated carbamate, from about 1 to 6% by weight methylolated cyanuric acid and from about 2 to 10% by weight urea.

The term methylolated carbamate as used herein means a compound having the formula:

$$RO(CH_2CH_2O)_n\underset{\underset{O}{\|}}{C}-N(CH_2OH)_x$$

wherein R is an alkyl group having 1 to 6 carbon atoms, $n$ is an integer from 1 to 10 and $x$ is 1 or 2.

The term methylolated cyanuric acid means cyanuric acid having the group - $CH_2OH$ attached to one, two, or all three of its nitrogen atoms.

The preferred methylolated carbamates are those wherein $n$ is 1 and R is methyl, ethyl, propyl, isopropyl, butyl, isobutyl, pentyl, isopentyl, hexyl, and the like.

The compositions of the present invention are useful for imparting crease or wrinkle resistance to cellulosic textile fabrics. The present compositions are conveniently applied to cellulosic textile fabrics as an aqueous solution having a solids content which can be varied over a wide range which, however, preferably would not extend below 2% nor above 80%. The aqueous treating solution can also contain other ingredients such as softeners, wetting agents, water repellents, soil repellents, and the like in addition to a suitable curing catalyst such as zinc nitrate, magnesium chloride, isopropanolamine hydrochloride or any other acidic salt catalyst or mixtures thereof. Any curing catalyst conventionally employed to cure nitrogenous creaseproofing chemicals can also be employed to cure the novel chemicals of this invention.

The aqueous treating solutions are applied to the cellulosic fabric and conventional techniques such as padding can be employed. The pick-up on the fabric can also vary over a wide range, e.g., wet pick-ups of 50 to 100 percent based on the weight of the fabric.

After application to the fabric, the crease-proofing chemicals thus carried by the fabric are cured under suitable curing conditions such as at a curing temperature of 250° to 360° F. for 5 minutes to 1 minute. If desired, the fabric can be dried after application of the treating solution and prior to curing. While air drying at ambient temperatures can be employed, it is preferred and more expeditious to dry at elevated temperatures.

The fabric to be treated may be prepared in any desired manner such as by singeing, desizing, bleaching and other operations prior to impregnating with the novel creaseproofing chemical and catalyst according to the present invention. Substantially any type of cellulosic fabric can be treated according to this invention. For example, 100 percent cotton woven fabrics, cotton-synthetic fiber blends, 100 percent rayon, rayon-synthetic fiber blends, rayon-cotton blends, all can be treated in accordance with this invention to provide the advantages set forth hereinabove. The term synthetic or other fibers is intended to include rayon fibers, polyester fibers, such as Fortrel (registered trade mark of Fiber Industries, Inc.), which is a polyester comprising a polymerized polycondensate of terephthalic anhydride and ethylene glycol; nylon; polymers containing at least 80 percent polymerized actylonitrile, such as those available commercially under the trade names Orlon and Acrilan, and so on. Staple synthetic fibers, or continuous synthetic filaments, as desired, can be employed in the ways that are well known in the art. This invention, nevertheless, can be applied with advantage to any woven or knitted cellulosic fabric, with or without any amount of synthetic or other fibers. The term "cellulosic textile fabric" as used herein means any of the above-described fabrics, including blends which contain cellulosic fibers such as cotton, rayon and the like.

Variations and modifications may, of course, be made, without departing from the spirit and scope of the present invention.

Having thus described my invention what I desire to secure are claimed by Letters Patent:

1. A creaseproofing composition comprising from about 2 to 12% by weight formaldehyde, from about 72 to 95% by weight methylolated carbamate, from about 1 to 6% by weight methylolated cyanuric acid and from about 2 to 10% by weight urea.

2. The composition of claim 1 wherein the methylolated carbamate has the formula:

$$R-O(CH_2CH_2O)_n\underset{\underset{O}{\|}}{C}-N(CH_2OH)_x$$

wherein R is an alkyl group having 1 to 6 carbon atoms, $n$ is an integer from 1 to 10 and $x$ is 1 or 2.

3. The composition of claim 1 wherein the methylolated carbamate is a mixture of two carbamates, each carbamate having the formula:

$$R-O(CH_2CH_2O)_n\underset{\underset{O}{\|}}{C}-N(CH_2OH)_x$$

wherein R is an alkyl group having 1 to 6 carbon atoms, $n$ is an integer from 1 to 10 and $x$ is 1 or 2, with the proviso that R and $n$ are the same for each carbamate, the only difference between said carbamates being the difference in the value of $x$.

4. A process for preparing the creaseproofing composition of claim 1 comprising:

a. reacting urea with a monoalkyl ether of an ethylene glycol having 1 to 10 ethyleneoxy groups wherein the alkyl group contains 1 to 6 carbon atoms;

b. removing excess monoalkyl ether from the reaction mixture; and c. reacting the remaining mixture without isolation therefrom of any carbamate formed therein with aqueous formaldehyde.

5. The process of claim 4 wherein a 100% to 400% stoichiometric excess of the monoalkyl ether is used and the reaction is carried out at a temperature above 100° C.

6. The process of claim 5 wherein the reaction is carried out at a temperature from about 120° to 150° C. for time sufficient to allow the urea level to decrease to about 1 to 8% of its original level.

7. The process of claim 4 wherein the monoalkyl ether is selected from the group consisting of the monoethyl ether of ethylene glycol, the monohexyl ether of ethylene glycol, the monoethyl ether of deca-ethylene glycol, the monobutyl ether of triethylene glycol, and the monoisobutyl ether of tetraethylene glycol.

8. The process of claim 4 wherein the amount of formaldehyde used is in a ratio from about 1.5 to about 3 moles of formaldehyde per mole of carbamate in the mixture and wherein the temperature of the reaction with formaldehyde is from about 20° C. to the reflux temperature of the reaction mixture.

9. A process for producing the creaseproofing composition of claim 1 comprising reacting a composition comprising from about 87 – 99% by weight of a carbamate having the formula:

$$RO(CH_2CH_2O)_n\underset{\underset{O}{\|}}{C}NH_2$$

wherein R is an alkyl group having 1 to 6 carbon atoms and *n* is an integer from 1 to 10; about 1 – 8% by weight urea and about 1 – 5% by weight cyanuric acid with aqueous formaldehyde.

10. The process of claim 9 wherein the amount of formaldehyde used is in a ratio from about 1.5 to about 3 moles of formaldehyde per mole of carbamate in the mixture and wherein the reaction is carried out at a temperature from about 20° C. to the reflux temperature of the reaction mixture.

11. A method for rendering cellulosic textile fabrics creaseproof by applying a solution of the composition of claim 1 in water, said solution having a solids content between about 2 and 80%, to the fabric to a wet pick-up of between about 50 to 100% based on the weight of the fabric, said aqueous solution also containing a catalyst capable of curing nitrogenous crease-proofing chemicals, and then curing the thus applied composition at a temperature in the range from about 250° to 360° F for a time from about 5 minutes to 1 minute.

12. A creaseproof cellulose textile fabric obtained from the process of claim 11.

* * * * *